US007178805B2

(12) United States Patent
Herbolich, Jr.

(10) Patent No.: US 7,178,805 B2
(45) Date of Patent: Feb. 20, 2007

(54) SUSPENDED MOBILE CONSTRUCTION GAME

(76) Inventor: Stephen Albert Herbolich, Jr., 1501 Mimosa Dr., Greensboro, NC (US) 27403

( * ) Notice: Subject to any disclaimer, the term of this patent is extended or adjusted under 35 U.S.C. 154(b) by 231 days.

(21) Appl. No.: 10/901,139

(22) Filed: Jul. 29, 2004

(65) Prior Publication Data

US 2006/0022410 A1 Feb. 2, 2006

(51) Int. Cl.
*A63F 9/26* (2006.01)

(52) U.S. Cl. ..... 273/449; 273/450

(58) Field of Classification Search ..... 273/447, 273/449, 450, 459, 156, 158; 446/396, 227, 446/399; D21/399, 482, 467
See application file for complete search history.

(56) References Cited

U.S. PATENT DOCUMENTS

| | | | | | |
|---|---|---|---|---|---|
| 83,160 | A | * | 10/1868 | Holt | 446/326 |
| 3,414,265 | A | * | 12/1968 | Marks | 273/156 |
| 3,717,340 | A | * | 2/1973 | Bowers | 273/450 |
| 3,807,731 | A | * | 4/1974 | Lemelson | 273/447 |
| 4,043,554 | A | * | 8/1977 | Wolf | 273/459 |
| 4,071,244 | A | | 1/1978 | Richards | |
| 4,293,128 | A | | 10/1981 | Ebal | |
| 4,438,727 | A | * | 3/1984 | Thompson | 119/708 |
| 4,522,393 | A | | 6/1985 | Dunn | |
| 4,522,403 | A | | 6/1985 | Maciorowski | |
| 5,240,260 | A | | 8/1993 | Strongin | |
| 5,332,231 | A | | 7/1994 | McIntosh | |
| 5,720,645 | A | * | 2/1998 | Duggan | 446/396 |
| 5,954,340 | A | | 9/1999 | Tedesco | |
| D414,818 | S | * | 10/1999 | Duggan | D21/399 |
| 2005/0017457 | A1 | * | 1/2005 | Dubinsky | 273/440 |
| 2006/0022410 | A1 | * | 2/2006 | Herbolich, Jr. | 273/449 |

FOREIGN PATENT DOCUMENTS

EP 0 310 334 A2 * 4/1989

OTHER PUBLICATIONS

Col, Jeananda, Enchanted Learning Company (5 printed pages attached) http:/,www.enchantedlearning.com/crafts/astronomy/solarsystemmodel/ 2001.

(Continued)

*Primary Examiner*—Raleigh W. Chiu
(74) *Attorney, Agent, or Firm*—MacCord Mason PLLC

(57) ABSTRACT

This invention is an educational game of suspension, balance, construction and strategy. It can be played alone or with others. An initial point of suspension support is set up. One of several ways is used to choose a particular starting game piece. The first player engages a piece in some way with the point of suspension. Play moves to the next player. That player engages their piece anywhere and any way on the suspended structure. Pieces that disengage and are no longer contiguous with the suspended structure during any player's turn become part of that player's stock. If any player successfully engages a piece without it or any other piece falling completely away from the structure then the predetermined value of that piece is added to their score. The game ends when any player runs out of all their stock. At this point all scores are compared and the highest score wins.

14 Claims, 8 Drawing Sheets

OTHER PUBLICATIONS

Figure 1A:
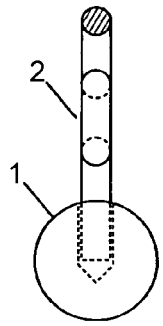

Col, Jeananda, Enchanted Learning Company (5 printed pages attached) http:/www.enchantedlearning.com/crafts/Whalemobile.shtml 1998.

Col, Jeananda, Enchanted Learning Company (4 printed pages attached) http:/www.enchantedlearning.com/crafts/mobiles/straws/ 2000.

* cited by examiner

SUSPENDED MOBILE CONSTRUCTION GAME

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to the sculptural art form known as the mobile created by the artist Alexander Calder, circa 1930, educational stimulus toys, strategy games and games of construction.

2. Related Art

Most construction toys such as building blocks rely on substructure support. These substructures depend on a solid surface to build up from. Balance and counterbalance around suspended pivot points do not apply. Other forms of construction toys rely on rigid connections of pieces.

U.S. Pat. No. 4,522,393 issued to Dunn sets forth a CENTER OF GRAVITY BLOCK REMOVAL APPRAISAL AND BALANCING GAME in which a plurality of elongated rectangular blocks are initially arranged in criss-cross layers to form a vertical stack and in which players attempt to remove blocks from the stack while avoiding tilting or tumbling the stack.

U.S. Pat. No. 4,293,128, inventor Ebel, describes a CENTER OF GRAVITY-APPRAISAL BLOCK GAME that also requires a player to examine the static state center of gravity of an assembly of blocks. You must guess where to place a block to create a different static state center of gravity that will not collapse the inflexible structure. In this example the player is less constrained in his or her placement of a block.

There are many games that deal with the manuliplation of the center of gravity of a given construction. Examples of this are:

U.S. Pat. No. 5,332,231, held by McIntosh for an EXECUTIVE BALANCE TOY, where the center of gravity is shifted through the limited arc of a support mounted between two slots and the placing of weights.

U.S. Pat. No. 4,522,403, to Maciorowski for a game, BALANCE TOY where a solid shape made of rotatable, off-center, weighted rings wobbles from vertical as the rings are rotated.

U.S. Pat. No. 5,240,260 to Strongin for a TOY GAME APPARATUS, a vertical balance game. It requires a player to steadily place small balls, using a tool, in specific locations. It is complicated by random shifting of the structure caused by sound from players.

U.S. Pat. No. 5,954,340 to Tedesco where a similar vertical structure's center of gravity is affected by the placement of token on a number of provided platforms that depend on the vertical assembly.

U.S. Pat. No. 4,071,244 issued to Richards, is a SUSPENSION GAME played with blocks. In this game a bridge-like suspended structure is constructed using differently shaped blocks. The structure depends from a fixed vertical rod and relies on the weight of the blocks against the rod to keep it aloft. The blocks engage loosely but do not form pivot points or have the aim of controlling shifting centers of gravity.

Existing forms of mobiles are generally fixed in design and meant for viewing only. Enchanted Learning Company provides Internet Web sites where educational mobile designs may be found. Two examples of construction directions for self made mobiles that are meant primarily for viewing once constructed can be found at: http:/www.enchantedlearning.com/crafts/astronomy/solarsystemmodel/ (SOLAR SYSTEM MODEL by Col, Jeananda, 2001) http:/www.enchantedlearning.com/crafts/Whalemobile.shtml (WHALE MOBILE by Col, Jeananda, 1998)

The appeal of these type of mobiles is in the initial fixed construction and in the resulting visual effect of gently undulating representative shapes. There is no other interaction with these types of mobile.

An exception to this can also be found at the Enchanted Learning Company Internet Web site:

http:/www.enchantedlearning.com/crafts/mobiles/straws/

(DRINKING STRAW MOBILE by Col, Jeananda, 2000)

In this case the person has the same interaction as with the last two examples but with the addition of the ability to adjust the positions of the weights by sliding them along suspended beams. This changes the center of gravity of the mobile.

Some mobiles are meant for physical interaction with suspended elements but not the relocation of the suspension points as in U.S. Pat. No. 4,438,727, granted to Thompson for MOBILE TOY FOR KITTEN OR SIMILAR ANIMAL. All suspension points are fixed and can not disengage. This type mobile hangs in equilibrium until touched whereupon it gyrates wildly.

Existing examples do not encourage much interaction beyond the visual. The examples are limited to action caused by wind, water, motor or human touch. There is no construction beyond the pre-planned first assembly. There is little chance to examine balance through the combination of weight (mass) and distance relative to pivot points.

The improvements this invention provides are that it encourages strategy by the exploration and exploitation of: (a) balance, (b) pivot points, (c) the relationship of weight/mass and distance relative to pivot points, (d) center of gravity and (e) vectors of force operating upon a suspended structure and (f) reactions of loose, dislodge-able connections. It requires players to examine the relationships of all these factors in a structure that is suspended movably in air rather than depending on a solid surface providing stability. The complex relationships resulting from the inherent nature of this invention's pivotable engagements causes the center of gravity of the suspended structure to constantly shift. The resulting ongoing state of change challenges a player's intuition. He or she must examine the pivot points and connections to make a hypothesis of the future state of the structure given a particular piece engaged a certain way. A player can create steady or strategically unsteady connections. Pieces connected unsteadily may unexpectedly fall by the action of an opponent. See FIG. 10. Steady connections reduce extreme acute angles therefore stabilizing a suspended structure. See FIG. 11.

DETAILED DESCRIPTION

Drawing Index

Figure 1:
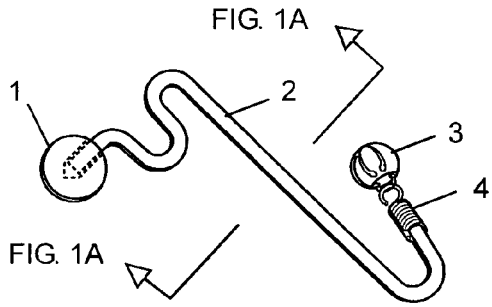

The following is a listing of drawings:

FIG. 1 Isometric view with a section cut indicating a normal section view shown in FIG. 1A. The isometric view describes a possible game piece of least weight consisting of a solid extrusion (2), an end cap (4), with an ornamental object attached that provides a pleasant sound when moved (3) and a spherical cap (1).

Figure 2A:
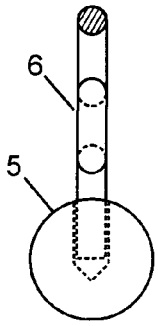
Figure 2:
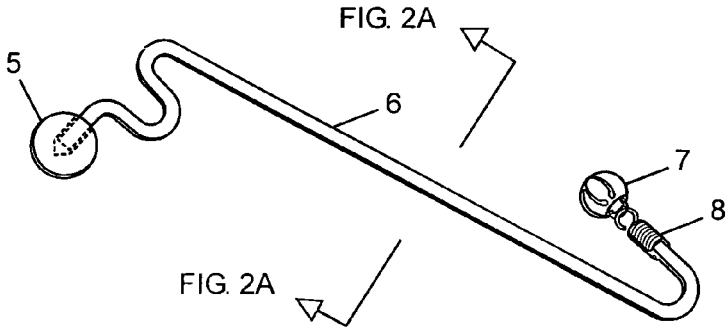

FIG. 2 Isometric view with a section cut indicating a normal section view shown in FIG. 2A. The isometric view describes a possible game piece of heavier weight consisting of a solid extrusion (6), an end cap (8), with an ornamental object attached that provides a pleasant sound when moved (7) and a spherical cap (5).

Figure 3:
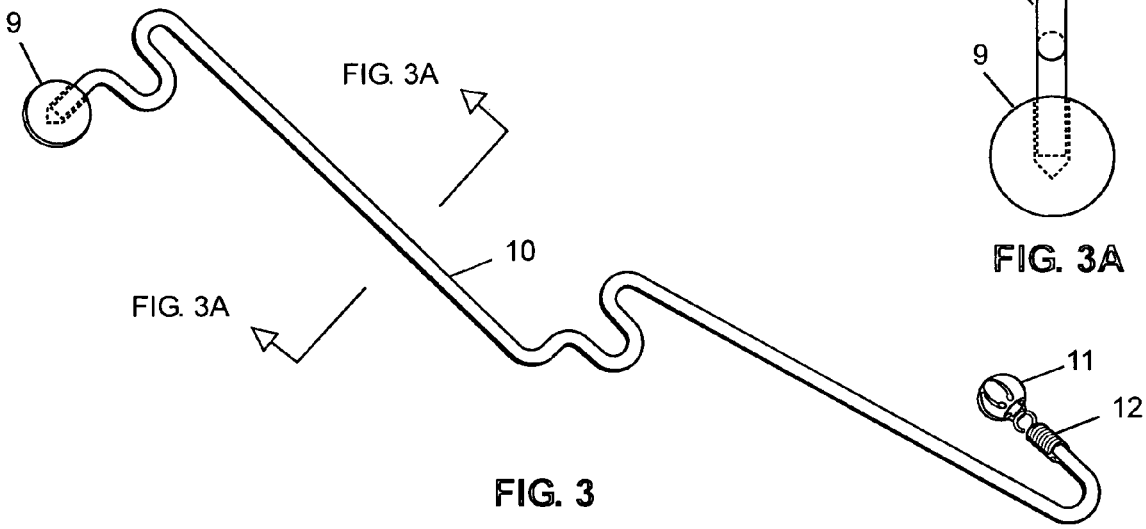
Figure 3A:
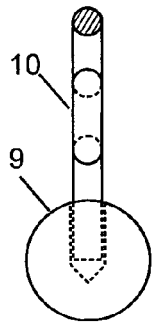

FIG. 3 Isometric view with a section cut indicating a normal section view shown in FIG. 3A. The isometric view describes a possible game piece of heavier weight than that of FIG. 2 with additional engagement features and consisting of a solid extrusion (10), an end cap (12), an ornamental object that provides a pleasant sound when moved (11) and a spherical cap (9).

Figure 4A:
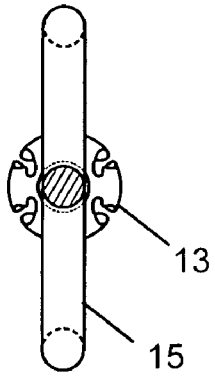
Figure 4:
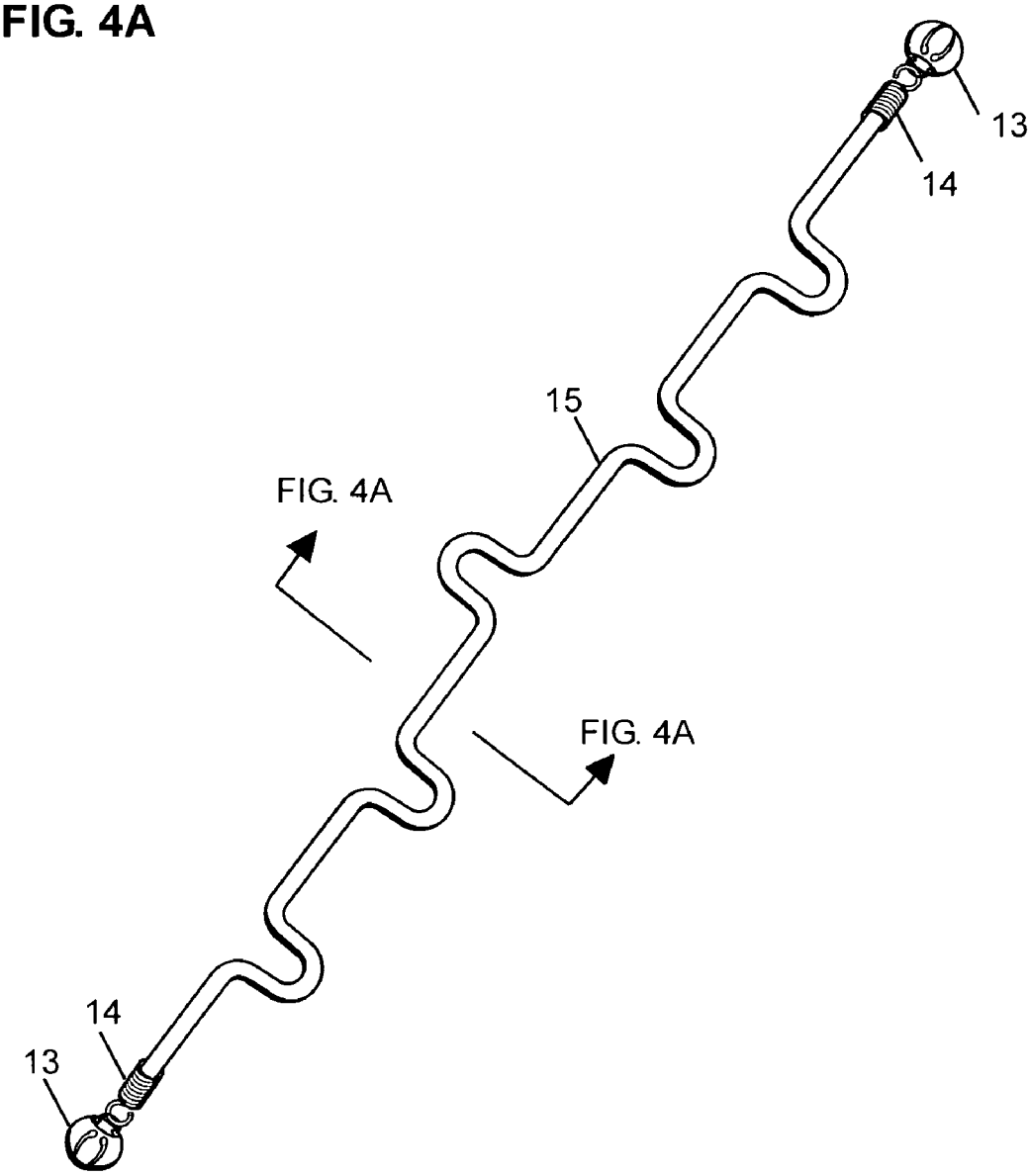

FIG. 4 Isometric view with a section cut indicating a normal section view shown in FIG. 4A. The isometric view describes a possible game piece of similar weight to that of FIG. 3 with additional engagement features and consisting of a solid extrusion (15), two end caps (14), two ornamental objects that provide a pleasant sound when moved (13).

Figures 5, 5A:
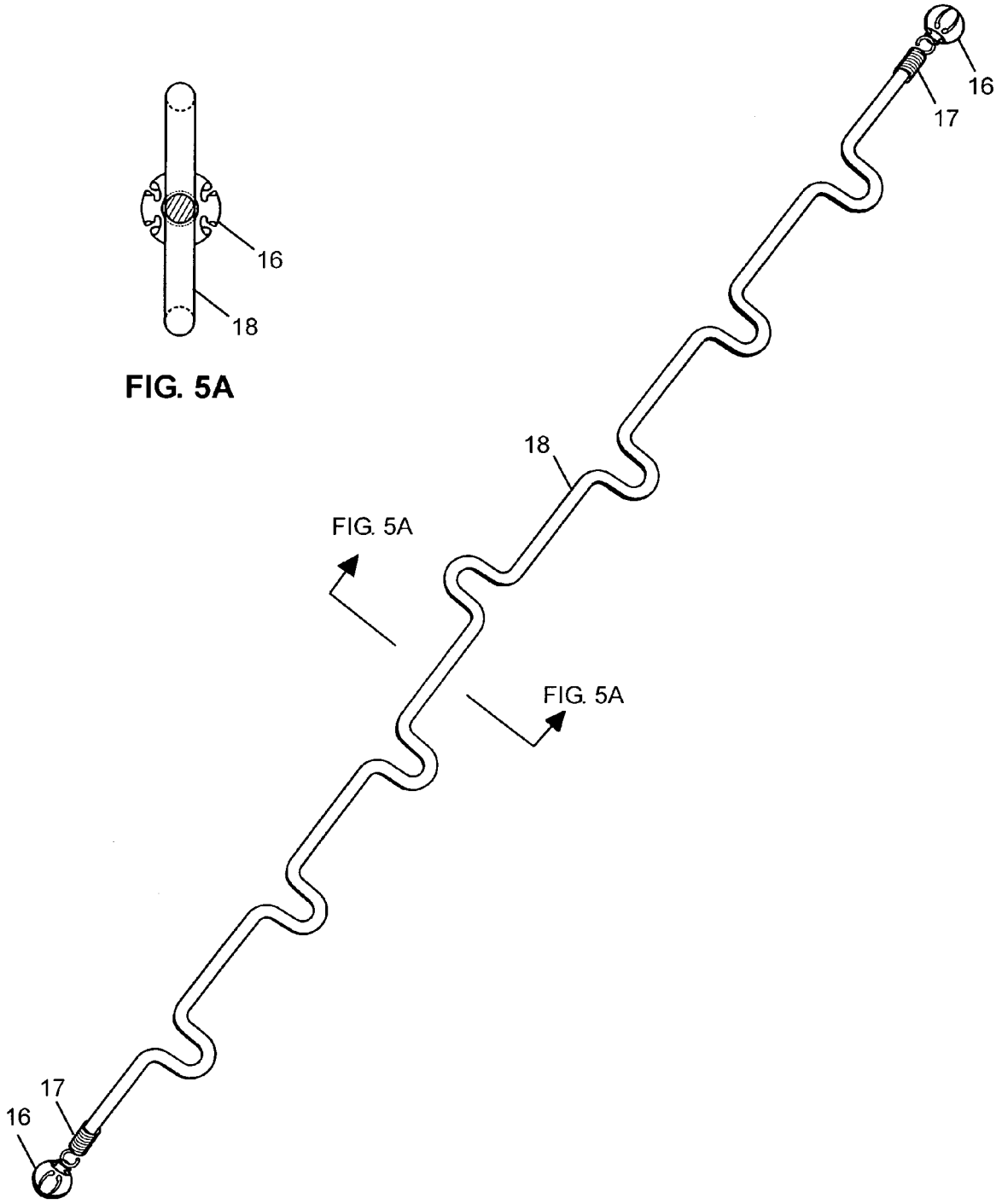

FIG. 5 Isometric view with a section cut indicating a normal section view shown in FIG. 5A. The isometric view describes a possible game piece of heavier weight than that of FIG. 4 with additional engagement features and consisting of a solid extrusion (18), two end caps (17) and two ornamental objects that provide a pleasant sound when moved (16).

Figure 6:
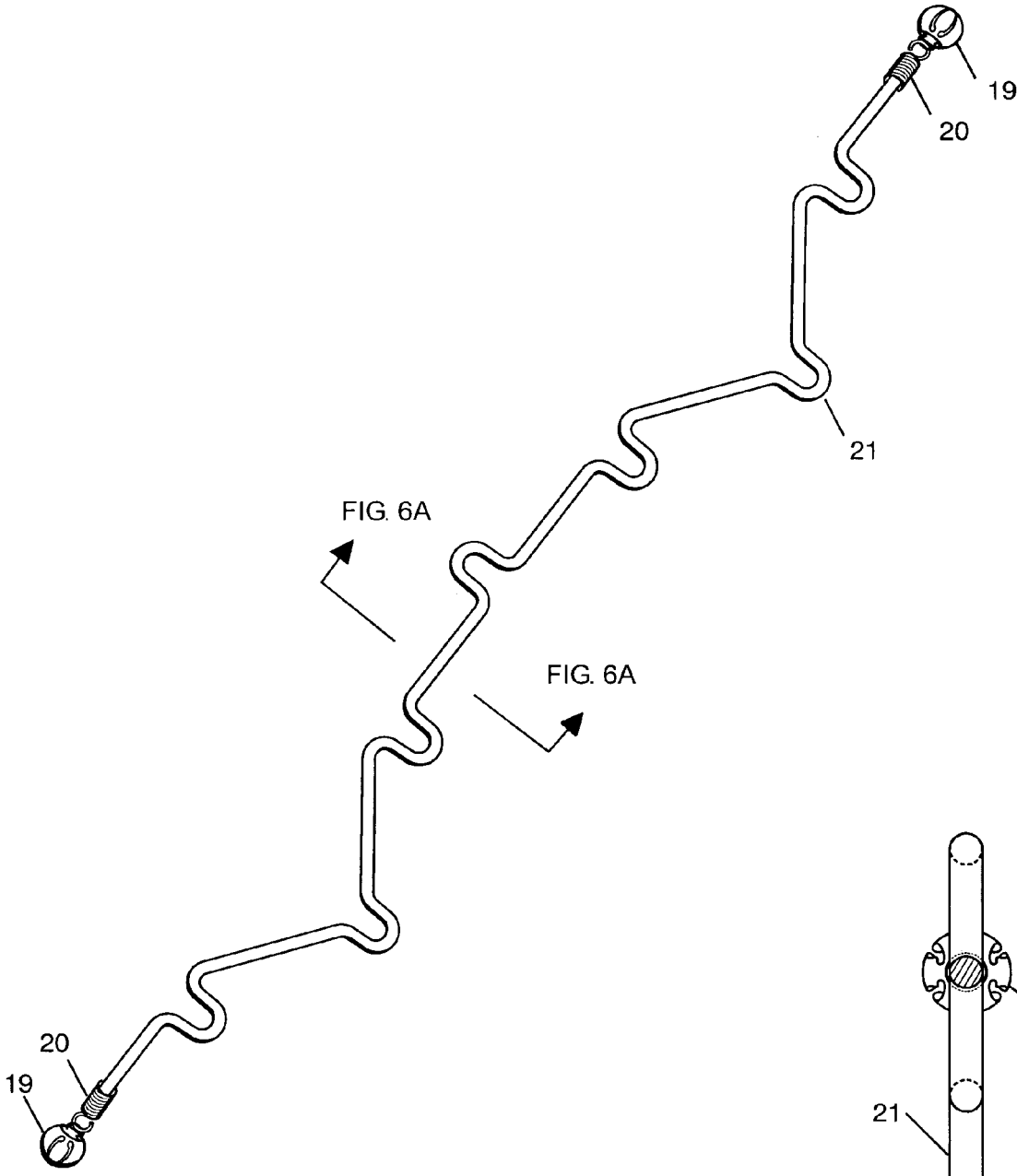
Figure 6A:
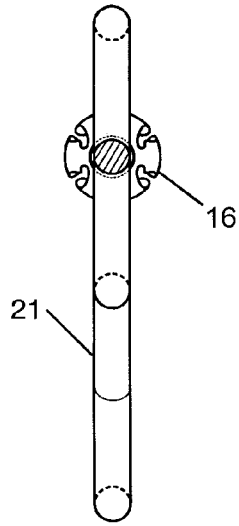

FIG. 6 Isometric view with a section cut indicating a normal section view shown in FIG. 6A. The isometric view describes a possible game piece of heavier weight than that of FIG. 5 with additional engagement features and consisting of a solid extrusion (21), two end caps (20) and two ornamental objects that provide a pleasant sound when moved (19).

Figures 7, 8, 9:
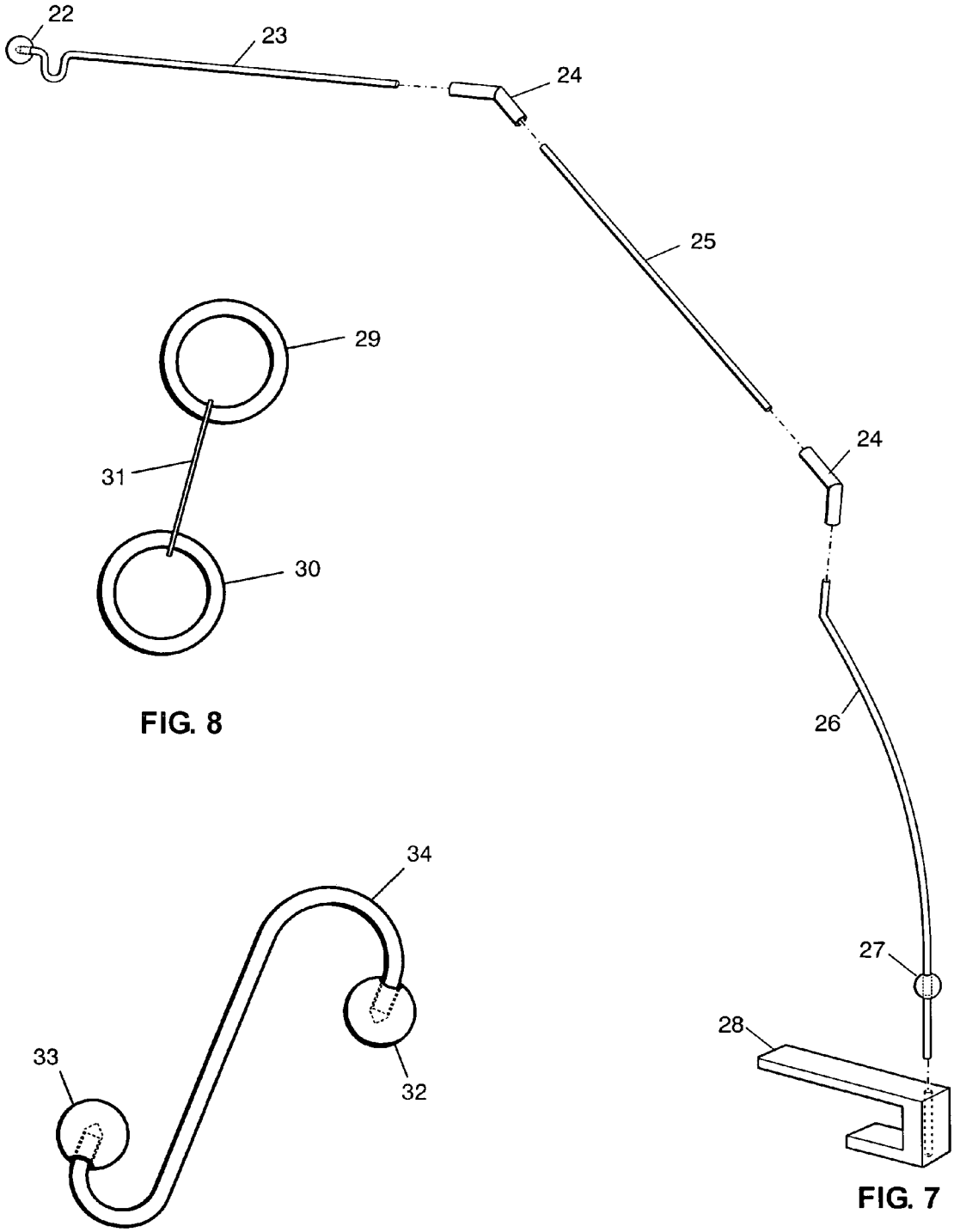

FIG. 7 Isometric view describing one possible means of establishing an initial point of suspension. It illustrates a spherical cap (22), two connectors (24), three different extrusions (26), (25) and (23), a spherical spacer stop (27) and a clip device (28).

FIG. 8 Isometric view describing another possible means of establishing an initial point of suspension. It illustrates two solid rings (29), (30) and material, (31), connected to both rings and stretching between them.

FIG. 9 Isometric view describing an additional means of establishing an initial point of suspension. It illustrates spherical caps (32), (33) and a solid extrusion connecting to and extending between them (34).

Figure 10:
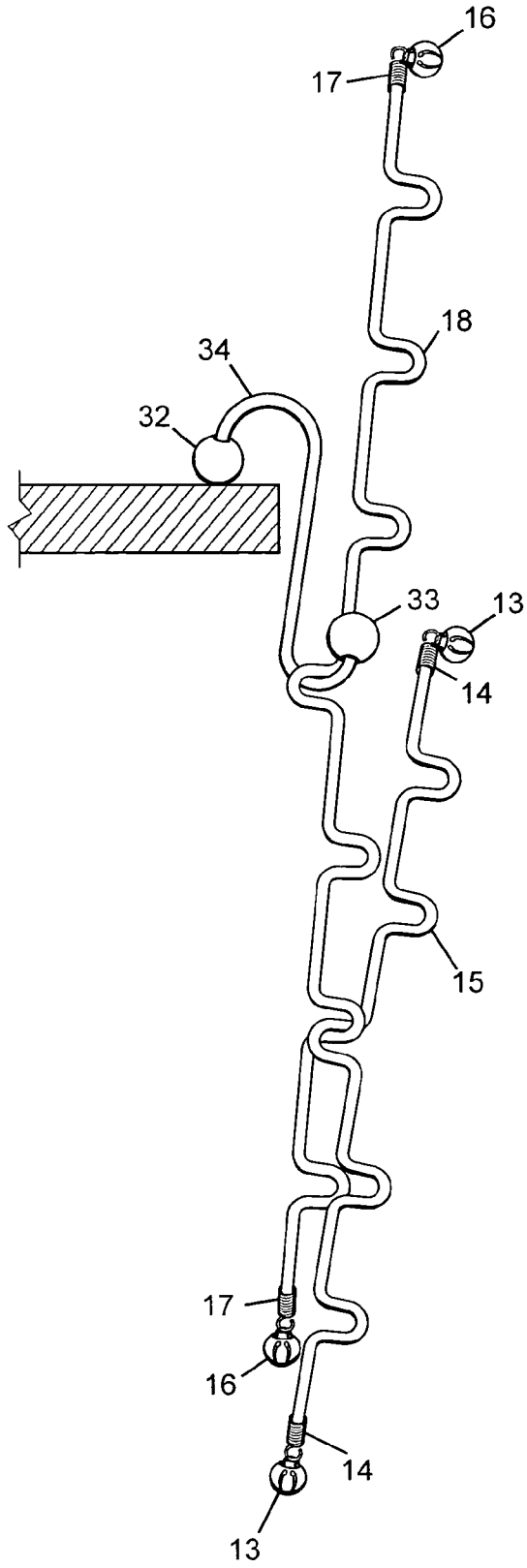

FIG. 10 Isometric view describing a suspended structure resulting from a game in play that is in an unstable state.

Figure 11:
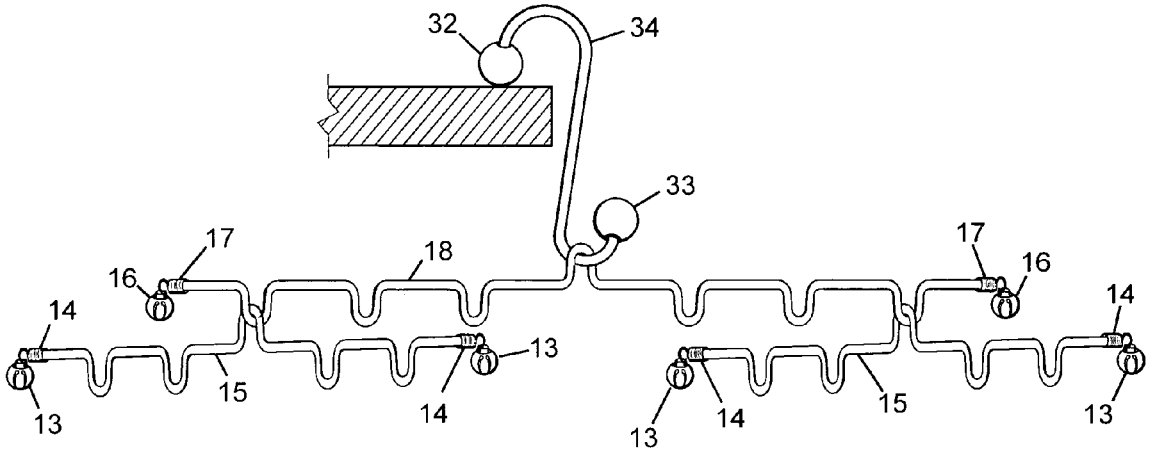

FIG. 11 Isometric view describing a suspended structure resulting from a game in play that is in a balanced state of equilibrium.

Figure 12:
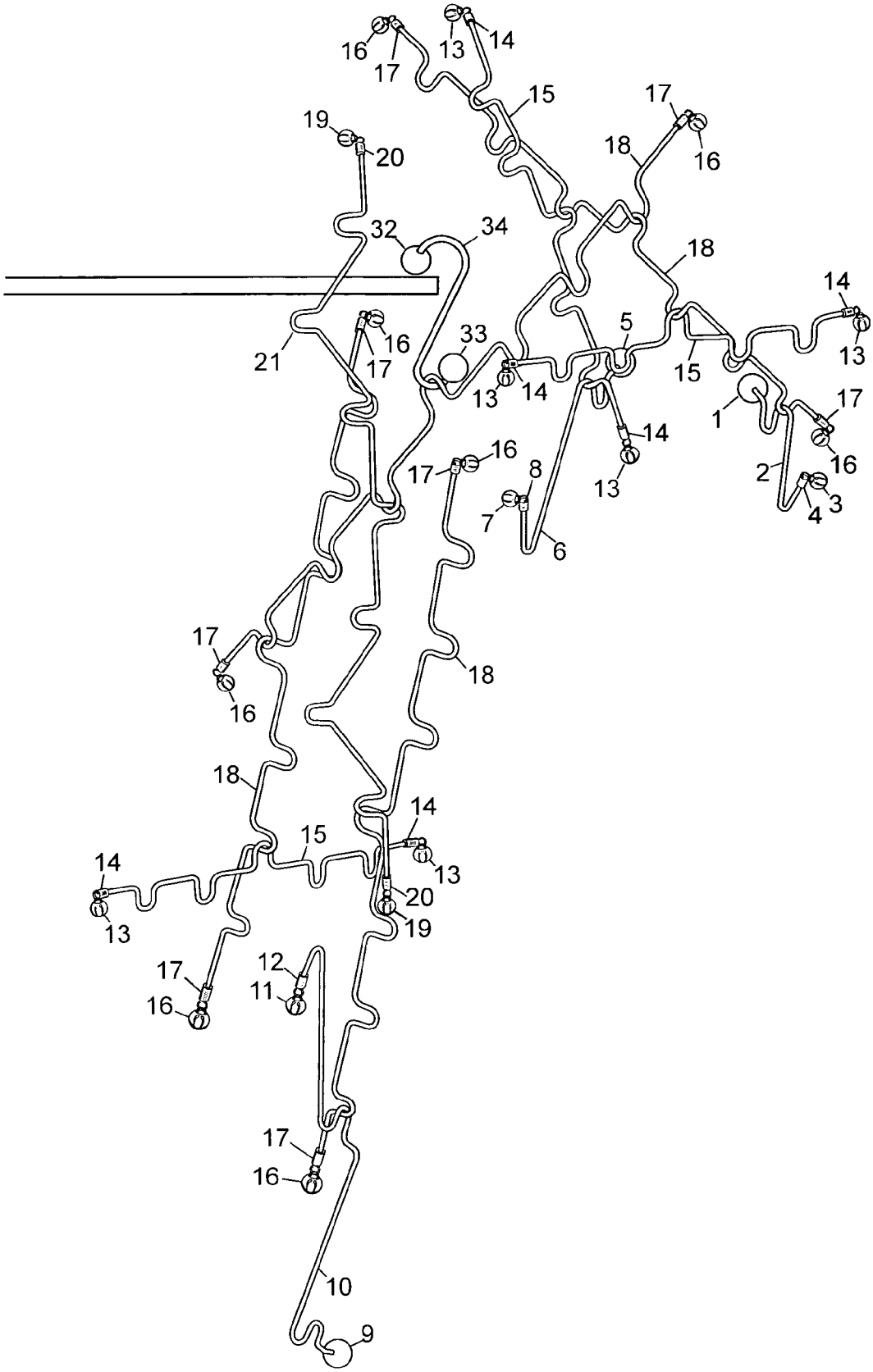

FIG. 12 Isometric view describing a suspended structure resulting from a game in play.

PREFERRED EMBODIMENT

This game can be played alone or with others. There are a plurity of types of point of suspension support means to choose from. Some but not all means are: (1) a flexible rod assembly depending on a surface or structure. See FIG. 7. This means allows vertical movement as weight is added or suddenly removed. Lateral arc shifts are also probable. The shift is from vertical relative to a point of suspension. These shifts are due to changes in the center of gravity as game pieces are added. (2) A string and loop assembly that can depend from various objects. See FIG. 8. This vertically fixed assembly allows full rotation on the horizontal. As in the first example lateral arc shifts are also probable. (3) A non-flexible object with two ends. These ends can be engaged with various objects to provide a point of suspension. This point of suspension is fixed vertically and will have a limited rotational motion range. See FIG. 9. Number (1) is the most challenging suspension. Number (2) is easier and number (3) is the least challenging. The aforementioned means may be used in combination to create additional challenges. Those of ordinary skill may envisage certain additions and/or modifications to these aforementioned means which; although not explicitly identified or suggested herein, do not depart from the sprit or scope of the described means.

The preferred embodiment continues as follows. A player selects a piece from their stock of game pieces using one of the following methods: (1) a six sided, numbered die. Each number associated with one of six different weight (mass) classes. See FIGS. 1 through 6. (2) A six sided die with each face a different color. Each color is associated with one of six different weight (mass) classes. See FIGS. 1 through 6. (3) Free choice by players. (4) Selection from a deck of collectable, game piece representative, cards. Those of ordinary skill may envisage certain additions and/or modifications to these aforementioned means which; although not explicitly identified or suggested herein, do not depart from the sprit or scope of the described means. The first player engages the piece in some way from the point of suspension. A turn consists of the placement of one game piece. Players take turns adding pieces to a developing suspended structure. If a player does not have the specified piece they forfeit their turn and the next player continues play. During a turn a piece may be engaged anywhere and any way on the structure. Once a player has let go of a piece he or she cannot reposition it. Each game piece has at least one salient feature contour that will pivotably engage loosely contiguous to other contours on other pieces. Game pieces may disengage from each other unexpectedly due to the causal nature of the interaction of the feature contours. Pieces that fall completely away and are no longer contiguous with the structure during a players turn become part of that player's stock. During play you decide between increasing the difficulty for your opponent(s), at some risk to yourself, and creating stable structures at possibly less risk to yourself. Difficulty increases as more and more engagements each approach 89 degrees from the horizontal. See FIG. 10. It may not always be possible to engage a counterbalancing game piece that will bring an unsteady structure back into equilibrium as in FIG. 11. Each time a player places a game piece that remains connected with the structure the value of that piece is added to his or her score. Play ends when any one of the players has no more stock of game pieces. Player's scores are compared and the greatest score wins. The game pieces in this embodiment may be any subject matter, or form.

Another embodiment of play is to build completely balanced, suspended structures singularly or with others. Structures would vary widely due to different ways each piece can engage with others. The object of this embodiment of the invention is to explore symmetry and equilibrium in the context of weight (mass) and distance relative to pivot points. A player selects a piece of his or her choice from a general stock of game pieces. No points are awarded, as there is no winner or loser. Those of ordinary skill may envisage certain additions and/or modifications to these aforementioned means which; although not explicitly identified or suggested herein, do not depart from the sprit or scope of the described means.

Another embodiment would be a work environment stress-relieving version that has no real aim to score points to win or lose but rather to provide distraction and enjoyment during the workday. Game pieces are chosen at will. This embodiment is more a means of meditation rather than a game. The resulting mobiles will be visually engaging. The mobiles remain conducive to meditation once the construction stage is completed. The scale for this embodiment could be large or small. The game pieces may be any subject matter or form. Those of ordinary skill may envisage certain additions and/or modifications to these aforementioned means which; although not explicitly identified or suggested herein, do not depart from the sprit or scope of the described means.

An additional embodiment would be creating visual and/or tactile objects for any personal environment. The scale for this embodiment could be large or small. The prior art referenced in the field of invention section that most closely approaches this embodiment are the existing forms of mobiles. Those mobiles are generally fixed in design and meant for viewing only. The completely novel aspect of this embodiment is the ability to construct and rearrange the structure at will. The game pieces may be any subject matter or form. Those of ordinary skill may envisage certain additions and/or modifications to these aforementioned means which; although not explicitly identified or suggested herein, do not depart from the sprit or scope of the described means.

Game pieces can be made of coated or uncoated metal, plastic rod or other appropriate solid material that will allow the loose engagement of one piece with any other. Game pieces each have at least one salient feature that interlocks loosely with any of the other pieces. The different weight classes vary from one group to another in shape and color. The shapes shown in FIGS. 1 through 6 are not the only possible shapes that can be envisioned to represent the different classes. Any class may be represented by a plurality of shapes. Each player starts off with an equal stock of each weight class.

The present invention is defined by the claims appended hereto, with the foregoing descriptions being illustrative of the preferred embodiment and envisage certain additions deletions and/or modifications to the preferred embodiment and additional embodiments which, although not explicitly identified or suggested herein, do not depart from the sprit or scope of the invention, as defined by the appended claims.

I claim:

1. A game kit, comprising:

a support to establish an initial point of suspension support so that a game can proceed, a plurality of loosely interlockable game pieces, that can be pivotally engaged, loosely contiguous to the support and each other to develop a structure suspended from the support, wherein at least some of the game pieces have at least three salient feature contours that pivotally engage loosely contiguous to other such contours on other pieces, so that such salient features of a game piece to be played can be used by a game player to loosely interlock with structure suspended from the support, so that a player placing such game pieces on the support has at least three choices of potential interlocking placements, and instructions on use of the support and game pieces.

2. The game kit of claim 1 wherein game piece engagements may be steady or unsteady and arise from pivoting between game pieces resulting in a suspended structure subject to shifting centers of gravity, pivotally relational engagements, and sudden, unexpected disengagement of one or more game pieces from the structure of suspended game pieces.

3. A game kit as claimed in claim 1 further comprising means for choosing a game piece during a player's turn.

4. A game kit as claimed in claim 1 wherein the game piece is elongated and the salient feature contour is a U-shape in the game piece with an open end of the U-shape transverse to the elongation of the game piece.

5. A game kit as claimed in claim 1 wherein the instructions provide for:

a single point of suspension is established;

a stock of game pieces having predetermined values is distributed to each player;

a starting player is to select a piece using a predetermined means and hang the selected piece in some way from the initial point of suspension to begin building a suspended structure;

thereafter players are to take turns hanging a piece from their stock of game pieces on one or more game piece of the suspended structure;

each player is to be awarded a score addition of the predetermined value of a game piece hung by that player if the piece remains contiguous with any part of the suspended structure during the player's turn and is not otherwise supported, provided that if any pieces disengage from the suspended structure and are no longer contiguous with some part of the suspended structure during the player's turn, the disengaged piece becomes part of said player's stock of game pieces and no score addition is awarded, and play is to continue until a predetermined solution is reached.

6. A game kit as claimed in claim 5 wherein the instructions provide that the predetermined solution is reached when one player has used all of his or her stock of game pieces.

7. A game kit as claimed in claim 5 wherein the instructions provide that the predetermined solution is reached when there is no remaining unused stock or the suspended structure is collapsed.

8. A game kit as claimed in claim 1 wherein the instructions provide for:

a single point of suspension is established;

a stock of game pieces having predetermined values is maintained unassigned, to be subsequently selected by players;

a starting player is to select a piece using a predetermined means and hangs the selected piece in some way from the initial point of suspension to build a suspended structure;

thereafter players are to take turns hanging a game piece on one or more game piece of the suspended structure;

each player is to be awarded a score addition of the predetermined value of the game piece hung by that player if the piece remains contiguous with any part of the suspended structure during the player's turn and is not otherwise supported, provided that if any pieces disengage from the suspended structure and are no longer contiguous with some part of the suspended structure during the player's turn, no score addition is awarded, and play is to continue until a predetermined solution is reached.

9. A game kit as claimed in claim 1 wherein the instructions provide for:

game players to establish a point of suspension;

a starting player is to select a piece using a predetermined means and hang the selected piece in some way from the initial point of suspension to build a suspended structure;

thereafter players are to take turns hanging a game piece on one or more game piece of the suspended structure; and wherein there is no winner or loser and no points are awarded.

10. A game kit as claimed in claim 1 wherein the game piece has an elongated body with a U-shape distended from the elongated body, with an open end of the U-shape transverse to the elongation of the game piece and the body and U-shape being formed as one continuous piece.

11. A game kit as claimed in claim 1 wherein at least some of the game pieces have at least five salient feature contours that pivotally engage loosely contiguous to other such contours on other pieces, so that such salient features can be used by a game player to loosely interlock with structure suspended from the support, so that a player placing such game pieces on the support has at least five choices of potential interlocking placements.

12. A game kit as claimed in claim 1 wherein at least some of the game pieces have at least seven salient feature contours that pivotally engage loosely contiguous to other such contours on other pieces, so that such salient features can be used by a game player to loosely interlock with structure suspended from the support, so that a player placing such game pieces on the support has at least seven choices of potential interlocking placements.

13. A game kit as claimed in claim 1 wherein the support is configured so that it does not fall or collapse due to accumulated game pieces.

14. A game kit comprising:

a support to establish an initial point of suspension support, a plurality of loosely interlockable game pieces, each of which are elongated and have one or more U-shape portions with an open end of the U-shape transverse to the elongation of the game piece and can pivotally engage loosely contiguous to the support and other such U-shapes on other game pieces to develop a structure suspended from the support, wherein at least some of the game pieces have at least three salient feature contours that pivotally engage loosely contiguous to other such contours on other pieces, so that such salient features of a game piece to be played can be used by a game player to loosely interlock with structure suspended from the support, so that a player placing such game pieces on the support has at least three choices of potential interlocking placements.

means for choosing a game piece during a player's turn, and instructions on use of the support, means for choosing and game pieces, wherein game piece engagements in the suspended structure are subject to shifting centers of gravity, pivotally relational engagements, and sudden, unexpected disengagement of one or more game pieces from the suspended structure of game pieces.

* * * * *